United States Patent [19]

Bristow

[11] 4,237,992

[45] Dec. 9, 1980

[54] MODULAR LOAD-SUPPORT VEHICLE

[75] Inventor: Ian R. Bristow, Romsey, England

[73] Assignee: U.B.M. Hover Systems, Southampton, England

[21] Appl. No.: 906,533

[22] Filed: May 16, 1978

[30] Foreign Application Priority Data

May 17, 1977 [GB] United Kingdom ..... 20580/77

[51] Int. Cl.[3] ..... B60V 1/18

[52] U.S. Cl. ..... 180/116; 180/127; 180/14 R; 52/645; 220/84; 248/127

[58] Field of Search ..... 180/116, 117, 127; 52/648, 645; 248/127, 645, 648; 220/84; 214/1 R

[56] References Cited

U.S. PATENT DOCUMENTS

| | | | |
|---|---|---|---|
| 1,474,401 | 11/1923 | Bramley | 248/127 |
| 2,524,955 | 10/1950 | Borzell | 248/676 X |
| 3,106,260 | 10/1963 | Bollum | 180/116 |
| 3,258,236 | 6/1966 | Moritz | 248/127 |
| 3,401,767 | 9/1968 | Barr | 180/127 X |
| 3,662,853 | 5/1972 | Love | 180/116 X |
| 3,712,504 | 1/1973 | Petersen | 220/84 |
| 3,726,493 | 4/1973 | Muller | 180/127 X |
| 3,731,450 | 5/1973 | Duchateau | 52/648 |
| 3,811,583 | 5/1974 | Weeks | 180/127 |

*Primary Examiner*—John P. Silverstrim

*Attorney, Agent, or Firm*—Steele, Gould & Fried

[57] ABSTRACT

A load-support module comprises first and second frame structures of rectangular plan form disposed one above the other on a common central axis, with load support members attached to and extending between the structures. The frame structures are such that the modules can be stacked one on another in nested relationship. The modules are disposed in close-packed rows on a base frame structure, forming a load-support surface. Contiguous modules are demountably secured to one another and are each provided with fitted floor members. The entire structure is provided with a demountable, peripheral flexible skirt. A number of such structures can be combined to transport very large objects.

5 Claims, 17 Drawing Figures

FIG.1.
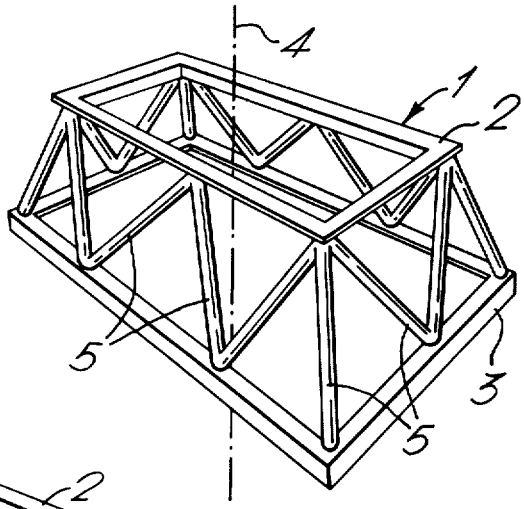
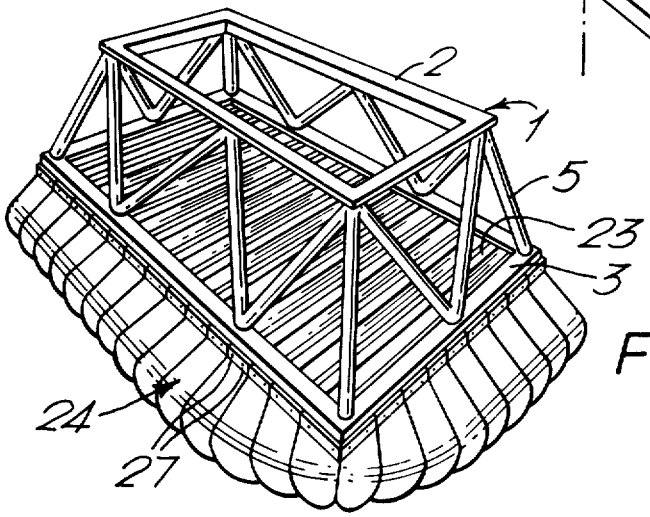
FIG.2.
FIG.3.
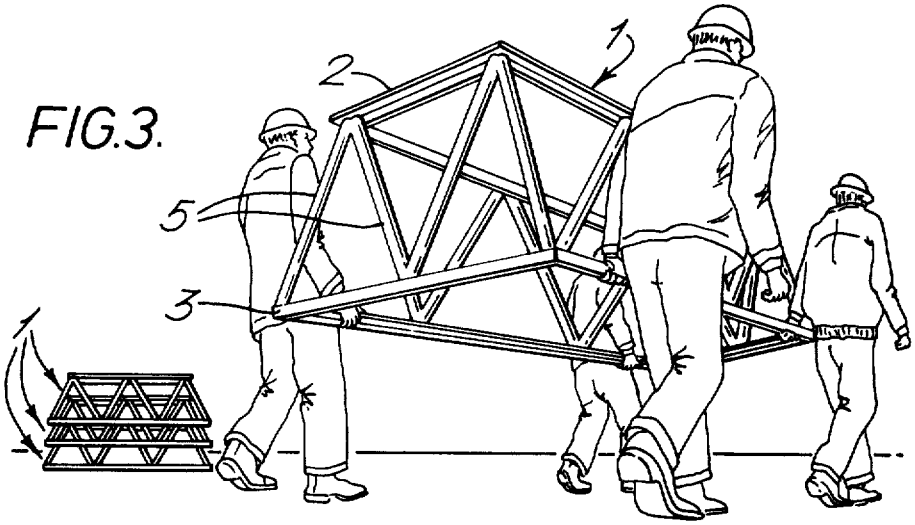

FIG.10.
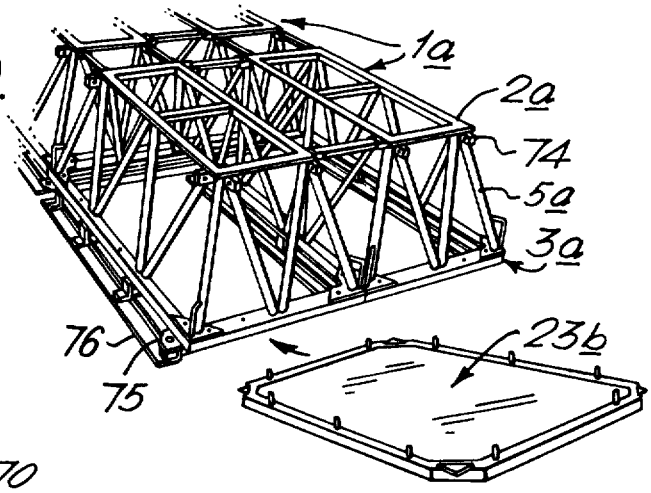
FIG.9.
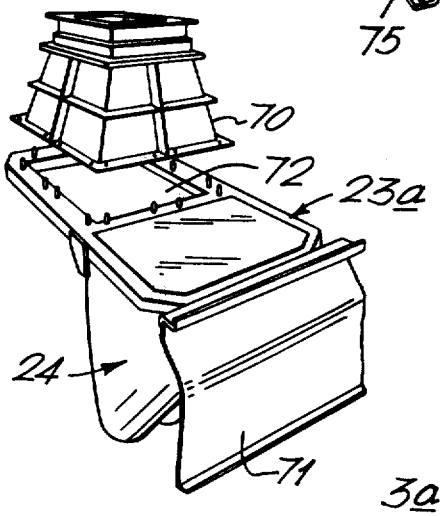
FIG.11.
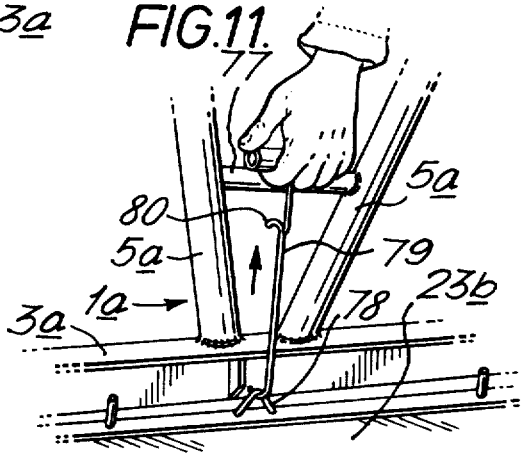
FIG.12.
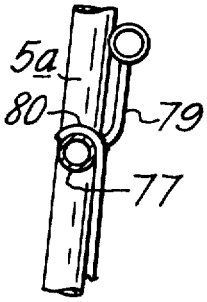
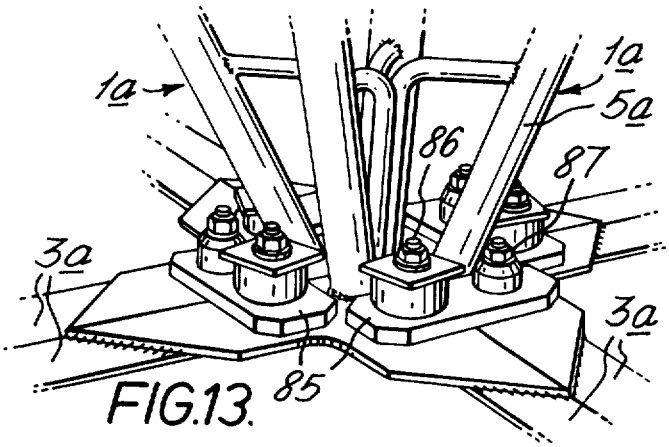
FIG.13.

MODULAR LOAD-SUPPORT VEHICLE

BACKGROUND TO THE INVENTION

This invention relates to load support modules and provides a stackable load support module particularly useful for assisting in the retrieval of disabled aircraft, especially from sites devoid of runways or other hard surfaces.

SUMMARIES OF THE INVENTION

A load support module comprises first and second frame structures of rectangular plan form disposed one above the other on a common central axis, with load support members attached to and extending between the structures, said structures having substantially the same plan form but of differing dimensions so that the sides of one structure are spaced further from the central axis than the sides of the other structure and so that the module can be stacked one on another in nested relationship.

The modules are disposed in close-packed rows on a base frame structure so as to form a load-support surface. Contiguous modules are demountably secured to one another, and are each provided with fitted floor members. The entire structure is provided with a demountable, peripheral flexible skirt.

As hereinafter explained, a number of such structures can be used to transport a disabled aircraft from a crash site.

The modules have other purposes as well.

BRIEF DESCRIPTION OF THE DRAWINGS

The various aspects of the invention will now be described, by way of example only, with reference to the accompanying drawings, wherein:

FIG. 1 is a view in perspective of a load-support module according to the invention, FIG. 2 is a similar view showing a portion of flexible skirt attached to the module, FIG. 3 illustrates how easily a module can be handled, FIGS. 9 to 17 are fragmentary views, in perspective, which illustrate various modifications.

In the figures, like reference numerals refer to like components.

DETAILED DESCRIPTIONS OF THE PREFERRED EMBODIMENT

Figure 4:
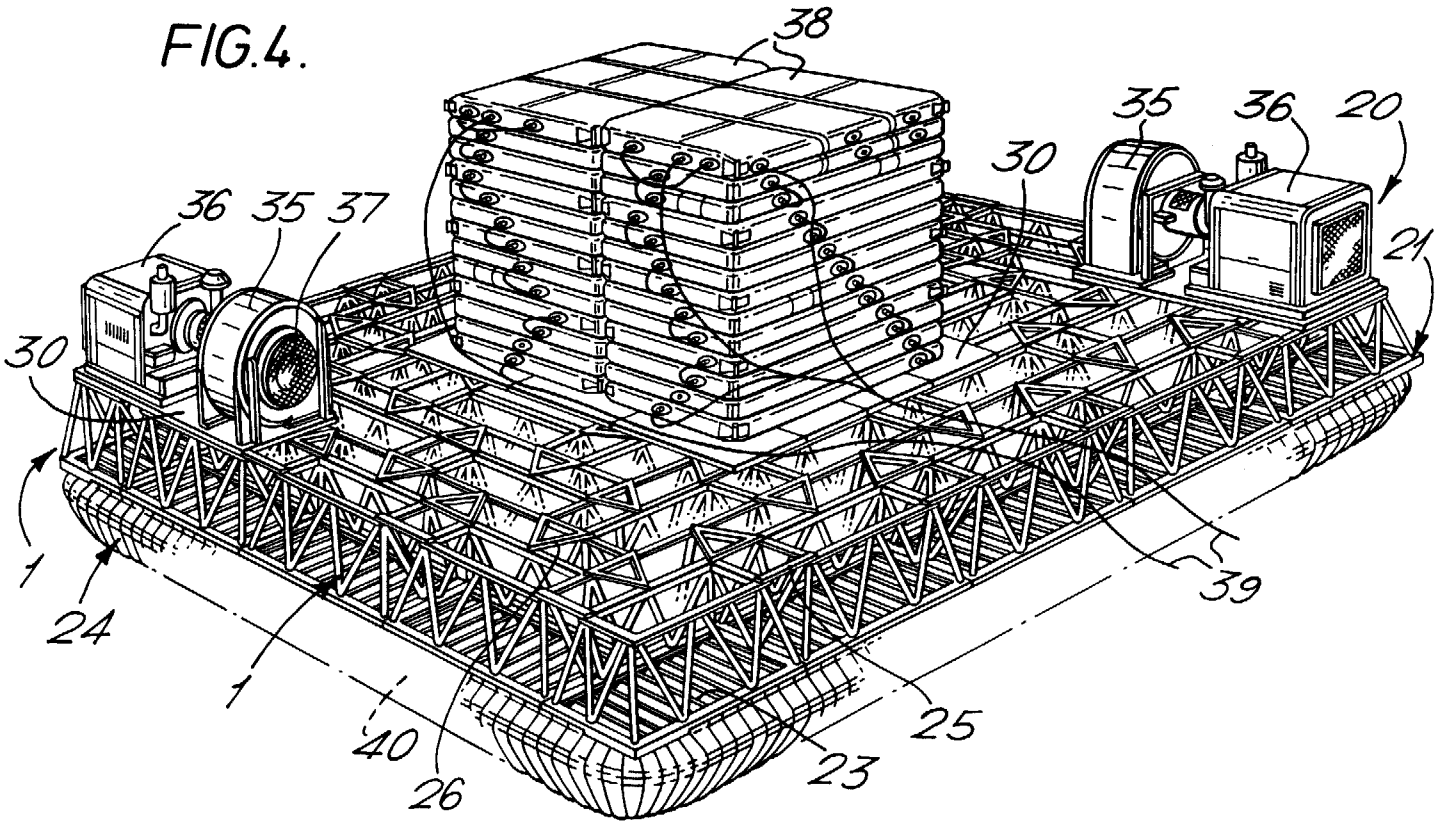
FIG. 4 is a view, in perspective, of a combination of a fluid-cushion-supported vehicle and a plurality of modules forming a platform.
Figure 5:
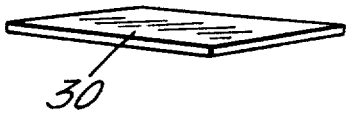
FIG. 5 is a view, in perspective, of one of several load-support panels used with the combination of FIG. 4.

With reference to FIG. 1, a load-support module 1 comprises first and second frame structures 2, 3 of rectangular plan form disposed one above the other on a common central axis 4. Load-support members in the form of struts 5 are attached to and extend between the (upper and lower) structures 2, 3.

The structures 2, 3 have substantially the same plan form, i.e. they both have a plan form which, (in this example), is oblong but of differing dimensions so that the outer sides or edges of one structure are spaced further from the central axis than the outer sides or edges of the other structure. Thus in this example, the outer sides of structure 3 are spaced further from axis 4 than the outer sides of structure 2, so that, when viewed in plan, structure 2 is disposed "co-axially" within structure 3, which forms a border around structure 2.

Thus the module 1 is formed so that, as shown in FIG. 3, it can be stacked on identical modules in nested relationship.

In further detail, each of the structures 2, 3 comprises lengths of "L"-section steel, welded together to form an open frame. In the case of structure 2, the junctions between the limbs of the "L"-section material are disposed inwardly, and in the case of structure 3, the said junctions are disposed outwardly. Thus the outermost, i.e. load-bearing surfaces of structures 2, 3 are substantially flat. The members 5, which comprise steel tubes, are welded to the structures 2, 3 and provide the module 1 with open-frame "walls" which incline inwardly as they extend from structure 3 to structure 2. The inclined "walls" provide the module 1 with both lateral and longitudinal vertical cross-sections of generally trapezoidal form.

Load-bearing modules 1 are particularly useful for assistance in the retrieval of disabled aircraft, especially from sites devoid of runways or other hard surfaces.

To this end, stacked groups of modules 1 may be transported by another aircraft to the region of the site. The modules 1 can then be transported to the site for assembly as hereinafter described. (FIG. 3 illustrates how easily a module 1 can be carried by four men).

With reference now to FIGS. 2, 4, 5 and 6, at the site, the modules 1 are used to form part of fluid-cushion-supported vehicles 20. (FIG. 4).

Each vehicle 20 is air-cushion supported. The body 21 of the vehicle comprises a large steel frame 22 (FIG. 6), around the periphery of which is attached, in a demountable manner, a flexible skirt 24. (The flexible skirt 24 is of the form disclosed by British Pat. No. 1,043,351, (corresponding to U.S. Pat. No. 3,420,330 of Bliss), to which reference should be made). Floor members 23 (FIG. 2) of corrugated form are fitted into the rectangular recesses defined by the lowermost "L"-sectioned structures of the modules 1, and the modules are placed in close-packed rows on top of the frame 22, to form a load-bearing platform.

Sealing strips, (not shown), are used where necessary so as to prevent leakage of cushion air.

Contiguous modules are secured together in a demountable manner using toggle-clamps, (not shown), or other suitable attachment means.

The surfaces defined by the (upper) structures 2 of the module 1 define a substantially coplanar load-carrying platform. Bridge members 25, 26 are used to close gaps between adjacent structures 2 of the modules.

As viewed from above, modules 1 in adjacent rows are "staggered" relative to each other. The arrangement, which resembles brick "bonding", provides a strong structure.

Some of the modules 1 forming the platform are inverted, whereby one module with its structure 3 uppermost is fitted between a pair of modules with their structures 3 lowermost. The "walls" of the modules 1 are inclined at angles which readily permit this juxtapositioning.

Figure 6:
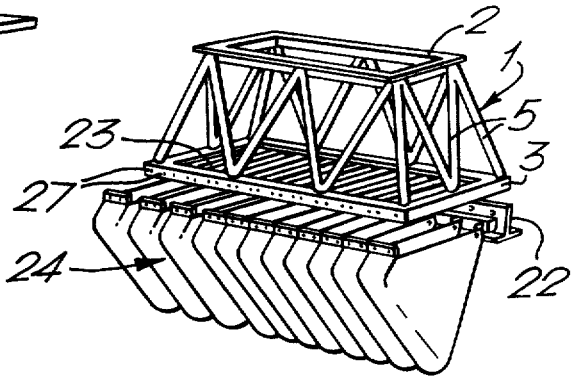
FIG. 6 is an "exploded" view, in perspective, of part of the combination of FIG. 4.

As shown in FIGS. 2 and 6, the outer side surfaces of at least some of the structures 3 are perforated by bolt holes 27 whereby the outer parts of the flexible shirt 24 are attached to the structure 3 at the periphery of the vehicle body 21.

As shown in FIG. 4, load-support panels 30 (FIG. 5) are placed on the load-carrying surface defined by the structures 2, 3. The panels 30 are used to support air blower/engine units 35/36 and inflatable load-support structures comprising air bags 38. The air blowers draw in atmospheric air by way of inlets 37 and discharge it, in a pressurized condition, to beneath the vehicle body 21 by way of flexible ducts, (not shown), so as to form a vehicle-supporting cushion 40. The flexible skirt 24 is open to and is inflated by the cushion 40.

The air bags 38 are inflated by an air compressor unit (not shown), by way of air supply lines 39. Means, (not shown), are provided to release inflation air from the bags 38.

Figure 7:
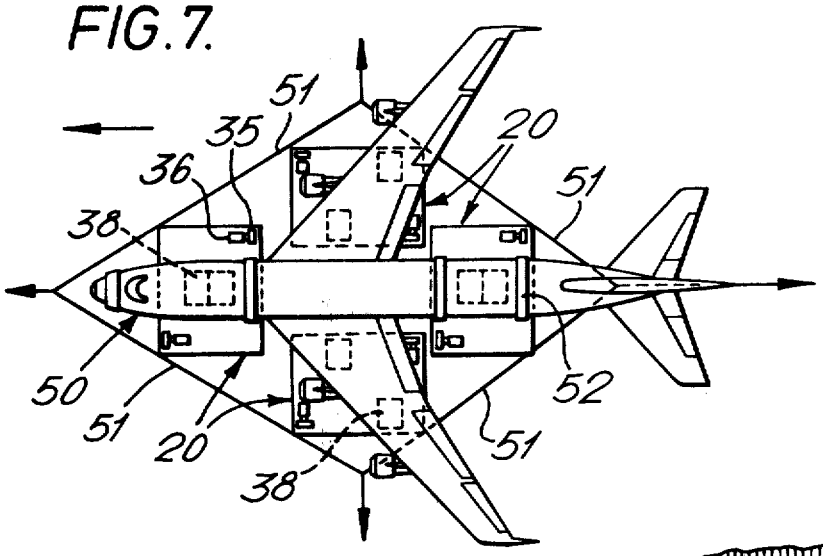
FIG. 7 is a plan view of a disabled aircraft being transported on a plurality of fluid-cushion-supported vehicles as shown in FIG. 5.

With reference now to FIG. 7, four vehicles 20 are here used to retrieve a large aircraft 50 in a disabled condition.

With the air bags 38 deflated, the vehicles 20 are manoeuvred beneath the fuselage and wings of the aircraft 50, using tractors or the like if necessary. With the vehicles 20 in position, and "on-cushion", the bags 38 are inflated so as to lift the aircraft 50 in a controlled manner.

With the use of tow wires 51 to link the vehicles 20, the aircraft 50 can now be transported over the ground, using winches and/or tractors. To prevent damage to the aircraft 50, means such as body straps 52 may be used during lift and transport. The straps 52 also tend to maintain aircraft stability during movement thereof, and also tend to reduce oscillation, caused by fluctuations in aircushion pressure.

During lift and transport of the aircraft 50, one of each pair of blower/engine units 35/36 is preferably run at substantially full power to provide lift whilst the other is run more slowly, so as to provide control.

The vehicles 20 allow retrieval of aircraft from all kinds of sites, including marshy grounds.

FIGS. 9 to 17 illustrate various modifications.

FIGS. 9 and 10 show modified floor members for covering the lowermost frame structures of modules 1.

In FIG. 9 a (non-corrugated) floor member 23*a* is used to support a cushion air supply duct 70. The lower end of duct 70 is bolted to the floor member 23*a* which is in turn bolted to the periphery of a lowermost frame structure 3*a*, (FIG. 10). Subsequently, the upper end of duct 70 is bolted to the outlet of a blower 35. (FIG. 4). The floor member 23*a* has an aperture 72 for free passage of cushion air.

The floor member 23*a* also carries a portion of the flexible skirt 24, as well as a portion of a dust/spray suppressor flap 71 which extends around the periphery of skirt 24.

FIG. 10 shows a group of intermediate modules 1*a*. These modules differ slightly in form from modules 1. Inter alia, the uppermost and lowermost frame structure 2*a*, 3*a* of modules 1*a* carry outwardly projecting lugs 74, 75.

FIG. 10 also illustrates how floor members 23*b* are bolted to frame structures 3*a* of the module 1*a*, and also shows skid/vehicle support members 76 of elongated form bolted to the frame structures 3*a* of the modules 1*a* forming the particular group shown.

FIGS. 11 and 12 illustrate how floor members 23*b* (and similarly floor members 23*a*) are held in position until secured by bolting. Support bars 77 are welded to adjacent members 5*a*, and lifting "rings" 78 are attached to peripheral points of floor members 23*b*. Special lifting hooks 79 are then used to lift the floor members 23*b* up to the frame structures 3*a*. The hooks 79 carry spurs 80 which rest on the bars 77, (see FIG. 12), keeping the member 23*b* in position until secured by the bolts.

Figure 14:
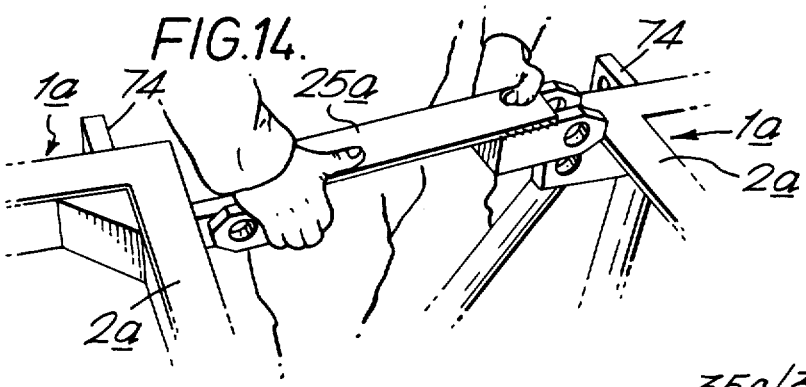

FIGS. 13 and 14 illustrate how adjacent modules 1*a* are interconnected, in a demountable manner. As shown in FIG. 13, adjacent frame structures 3*a* are coupled by clamping plates 85 held in place by nut and bolt assemblies 86, 87. As shown in FIG. 14, adjacent frame structures 2*a* are coupled by link members 25*a* held in place by bolts. (Not shown).

Figure 15:
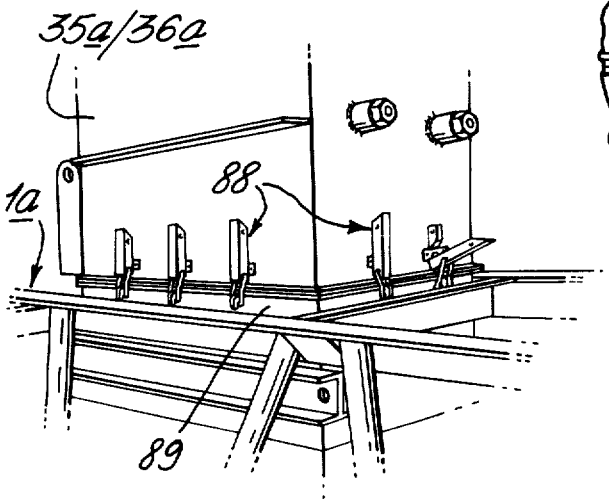
Figure 16:
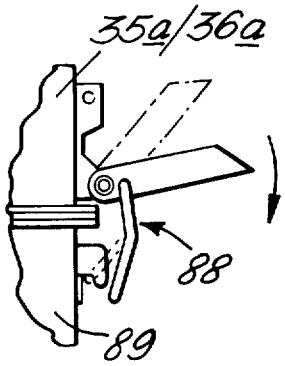

FIGS. 15 and 16 illustrate how a motor/fan unit 35*a*/36*a* is demountably held in place, using releasable toggle clamps 88, which couple the unit with a base-support structure 89 carried by adjacent modules 1*a*.

Figure 17:
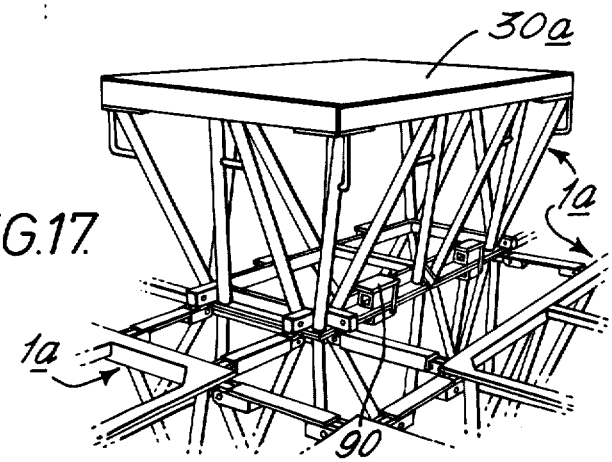

FIG. 17 illustrates how inverted modules 1*a* are placed upon the surface defined by non-inverted modules 1*a*, so as to increase the height, in a localised manner, of the vehicle. The inverted modules 1*a*, which carry load-support panels 30*a*, are held in place by demountable clamps 90.

It has been estimated that assembly of four sets each of forty modules 1, 1*a* (sufficient to retrieve a Boeing 747 aircraft), should take a team of eight only two days, although a skilled team could reduce this time.

The greater the number of modules 1, 1*a* used to form a load-carrying platform, the greater the weight supported thereby, as can be seen from the following table:

| Number of Modules | Weight Supported |
|---|---|
| 40 | 123,200 lbs |
| 35 | 105,280 lbs |
| 30 | 85,120 lbs |
| 25 | 67,200 lbs |
| 20 | 47,400 lbs |
| 15 | 33,600 lbs |

Figure 8:
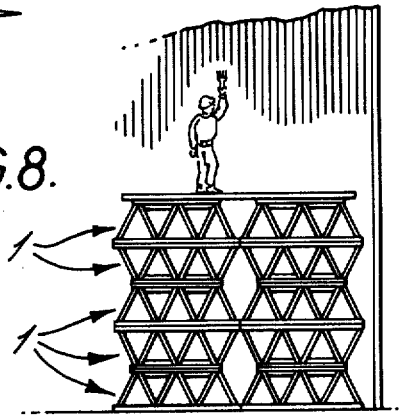
FIG. 8 is a side view of stacked modules supporting a working platform.

The modules have uses other than to retrieve aircraft. With reference to FIG. 8, modules 1 (or 1*a*) may be stacked so as to provide working platforms, in maintenance bays and other instances where conventional scaffolding would be used.

I claim:

1. A modular, demountable fluid-cushion-supported vehicle, comprising:

an openwork base frame structure;

a plurality of load-support modules disposed in close-packed rows on the base frame structure so as to form a load-support surface, each module comprising first and second openwork frame structures of rectangular plan form disposed one above the other on a common central axis, with load support members attached to and extending between the first and second frame structures, said first and second frame structures having substantially the same plan form but differing dimensions so that the sides of one of the first and second frame structures are spaced further from the central axis than the sides of the other of the first and second frame structures, whereby the modules can be stacked together one on another in nested relationship when disassembled, adjacent rows of the nested modules being staggered relative to each other;

floor members fitted into the lowermost of the first and second frame structures of the modules;

means for demountably securing contiguous modules together; and, a flexible skirt demountably attached to the periphery of the base frame structure.

2. A vehicle as claimed in claim 1, wherein the module has lateral and longitudinal vertical cross-sections of generally trapezoidal form.

3. A vehicle as claimed in claim 1, wherein each of the first and second frame structures is of "L"-section material with the limbs of the first frame structure disposed outwardly and the limbs of the second frame structure disposed inwardly.

4. A vehicle as claimed in claim 1, further comprising inflatable load-support members disposed on the load-support surface formed by the modules.

5. Apparatus for retrieving disabled aircraft, comprising:

a plurality of fluid-cushion-supported vehicles, each as claimed in claim 1;

means for linking the vehicles together;

means for stabilizing the disabled aircraft during movement of the vehicles; and, means for transporting the vehicles over the ground.

* * * * *